US006257900B1

(12) United States Patent
Huang et al.

(10) Patent No.: US 6,257,900 B1
(45) Date of Patent: Jul. 10, 2001

(54) ELECTRICAL CONNECTOR WITH CONTACTS HAVING IMPROVED RESILIENCY

(75) Inventors: Guan-Fu Huang; Shih Wei Hsiao, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/457,599

(22) Filed: Dec. 8, 1999

(30) Foreign Application Priority Data

Oct. 15, 1999 (TW) ..... 88217553

(51) Int. Cl.[7] ..... H01R 9/09
(52) U.S. Cl. ..... 439/74
(58) Field of Search ..... 439/74, 59, 61, 439/62

(56) References Cited

U.S. PATENT DOCUMENTS 5,161,985 * 11/1992 Ramsey ..... 439/74
5,224,866 * 7/1993 Nakamura et al. ..... 439/74 X
5,803,752 * 9/1998 McHugh ..... 439/74
5,885,092 * 3/1999 Ito et al. ..... 439/74
5,931,689 * 8/1999 Patel ..... 439/74 X

* cited by examiner

*Primary Examiner*—Renee Luebke
(74) *Attorney, Agent, or Firm*—Wei Te Chung

(57) ABSTRACT

An electrical connector for use in coupling two printed circuit board comprises an insulative housing and a plurality of contacts. The elongate rectangular housing comprises a bottom wall, two opposite sidewalls and a central projection parallel to and between the sidewalls. A pair of contact receiving slots is defined on both sides of the central projection extending through the bottom wall for receiving the contacts. Each contact includes a base portion, a transition portion and a spring contact arm. The transition portion includes a first horizontal section, a vertical section and a second horizontal section. The transition portion and the spring contact arm form three right angle transitions which provide sufficient resilient to establish a firm electrical connection between the contact and a terminal in a mating connector.

7 Claims, 6 Drawing Sheets

5

ELECTRICAL CONNECTOR WITH CONTACTS HAVING IMPROVED RESILIENCY

BACKGROUND OF THE INVENTION

1. Field of the Invention

The present invention relates to a connector, and particularly to an electrical connector for use in coupling two printed circuit board.

2. Description of the Prior Art

Examples of prior art are disclosed in U.S. Pat. No. 5,626,500 and Taiwan Patent Nos. 84203014 and 85203116. Referring to FIGS. 5–6, a conventional electrical connector 5 comprises an insulative housing 6 and a plurality of contacts 7. The housing 6 comprises a bottom 61, opposite sidewalls 62 extending upward from the bottom 61 and a central projection 64 extending upward from the bottom 61 and parallel to the sidewalls 62. A plurality of contact receiving cavities 65 are defined on both lower sides of the central projection 64 through the bottom 61 and are separated at regular intervals in a longitudinal direction by barriers (not labeled). Each contact 7 comprises a solder tail 72, a base section 71, a retaining section 73 and an S-shaped spring contact section 75. The solder tail 72 slightly slopes downward from one side of the base section 71 and then extends horizontally. The retaining section 73 upwardly extends from the other side of the base section 71 and forms arced projections 74 thereon to interfere with the barriers on each side of the contact receiving cavity 65. The S-shaped spring contact section 75 of the contact 7 has two U-shaped transitions 76 and a spring contact end 77 for contacting a mating element.

As the contacts are produced using a stamping and forming process, their manufacture is complex and a high precision punch is required to control the radial dimensions of the two U-shaped transitions. During production, one of two U-shaped sections may be inadvertently made into a V-shaped transition, thereby producing a contact with decreased resiliency and increased rigidity, thus increasing the force needed for insertion and extraction. Additionally, arced projections 74 of the contacts 7 can easily damage the thin barriers of the housing during assembly, causing short circuits between contacts 7.

Accordingly, an improved electrical connector is required to overcome the disadvantages of the prior art.

SUMMARY OF THE INVENTION

A first object of the present invention is to provide an electrical connector wherein a transition portion of each contact provides sufficient resiliency to accommodate the normal force exerted by a mating terminal, thereby preventing the contact from permanently deforming during mating.

A second object of the present invention is to provide an electrical connector wherein arced projections on the retaining section of each contact interfere with a side wall of the connector housing, not with ribs in the housing between the contacts, thereby preventing damage to the ribs and consequent short circuiting between the contacts.

An electrical connector of the present invention comprises an insulative housing and a plurality of contacts. The housing comprises a bottom wall, two opposite sidewalls and a central projection extending upward from the bottom wall and parallel to the opposite sidewalls. A pair of receiving slots are defined between the central projection and each sidewall for receiving a mating electrical connector. Each contact comprises a base portion, a transition portion and a spring contact arm. The transition portion includes a first horizontal section, a vertical section and a second horizontal section. The transition portion and the spring contact arm form three right angle curved transitions which provide sufficient resiliency to establish a firm electrical connection between the contact and a corresponding terminal on a mating connector.

Other objects, advantages and novel features of the invention will become more apparent from the following detailed description of the present embodiment when taken in conjunction with the accompanying drawings.

DETAILED DESCRIPTION OF THE INVENTION

Figure 1:
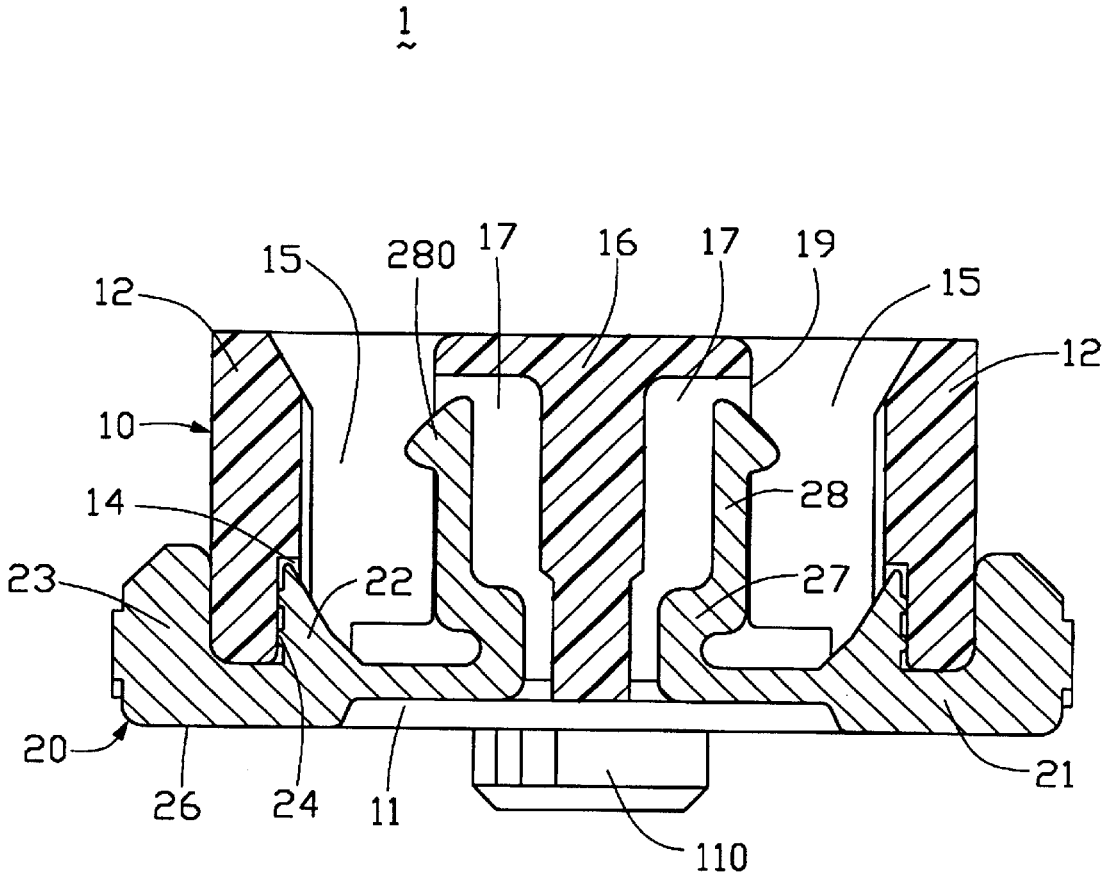
FIG. 1 is a sectional view of an electrical connector in accordance with the present invention.

Referring to FIG. 1, an electrical connector 1 of the present invention comprises an elongate rectangular insulative housing 10 and a plurality of contacts 20. The housing 10 comprises a bottom wall 11, two opposite sidewalls 12 extending upward from the bottom wall 11 and parallel to each other, and a central projection 16 upwardly extending from the bottom wall 11 and parallel to the opposite sidewalls 12. A pair of receiving slot 15 are defined between the central projection 16 and each sidewall 12 for receiving a mating electrical connector. Each sidewall 12 defines a plurality of recesses 14 at a lower inside edge thereof. The central projection 16 forms a plurality of ribs 19 at regular intervals along both sides of its length, thereby defining a plurality of receiving cavities 17. A pair of orientation legs 110 is formed at opposite ends of the bottom 11 of the housing 10 for positioning the connector 1 on a printed circuit board.

Figure 2:
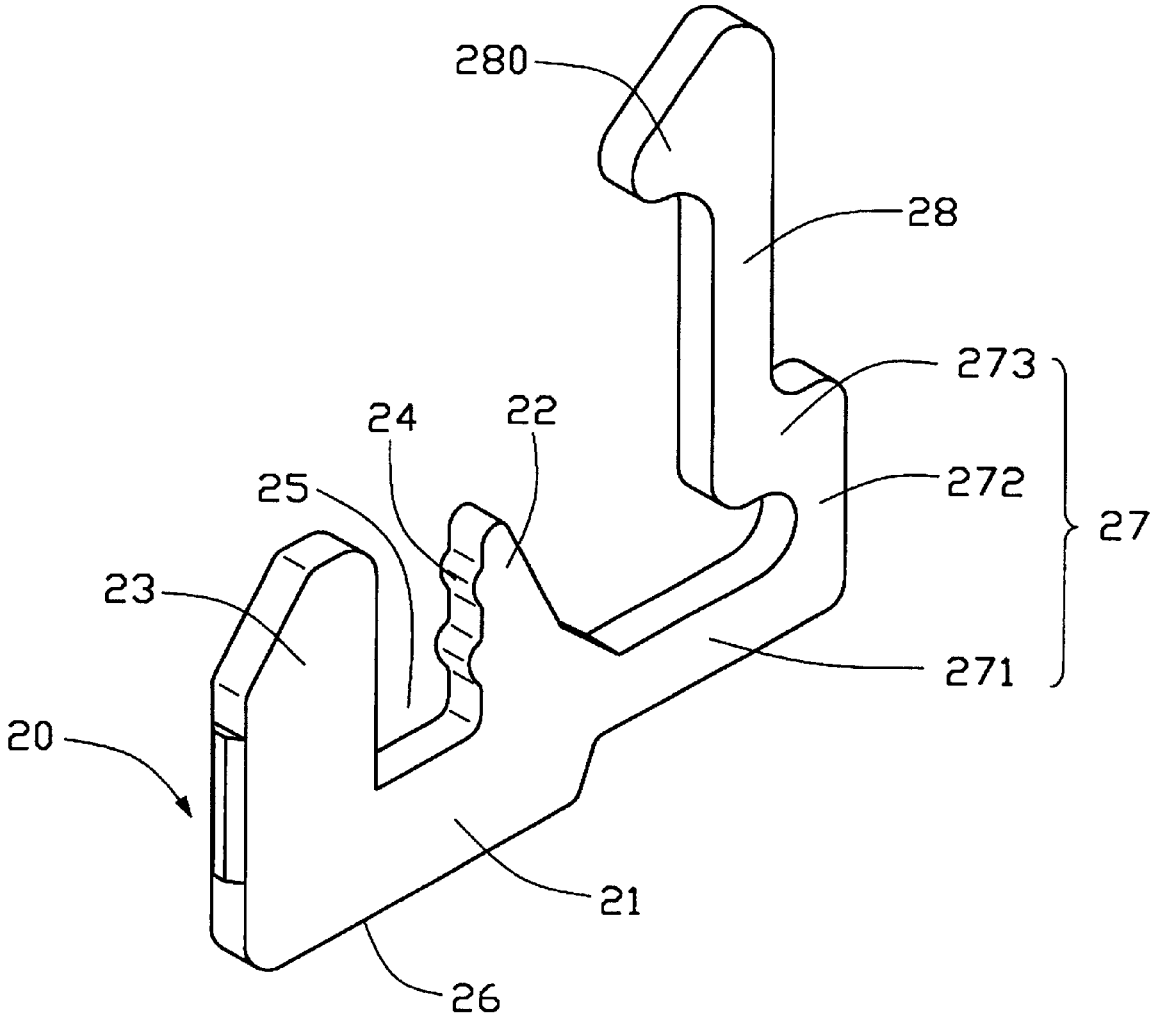
FIG. 2 is a perspective view of a contact of the present invention.
Figure 3:
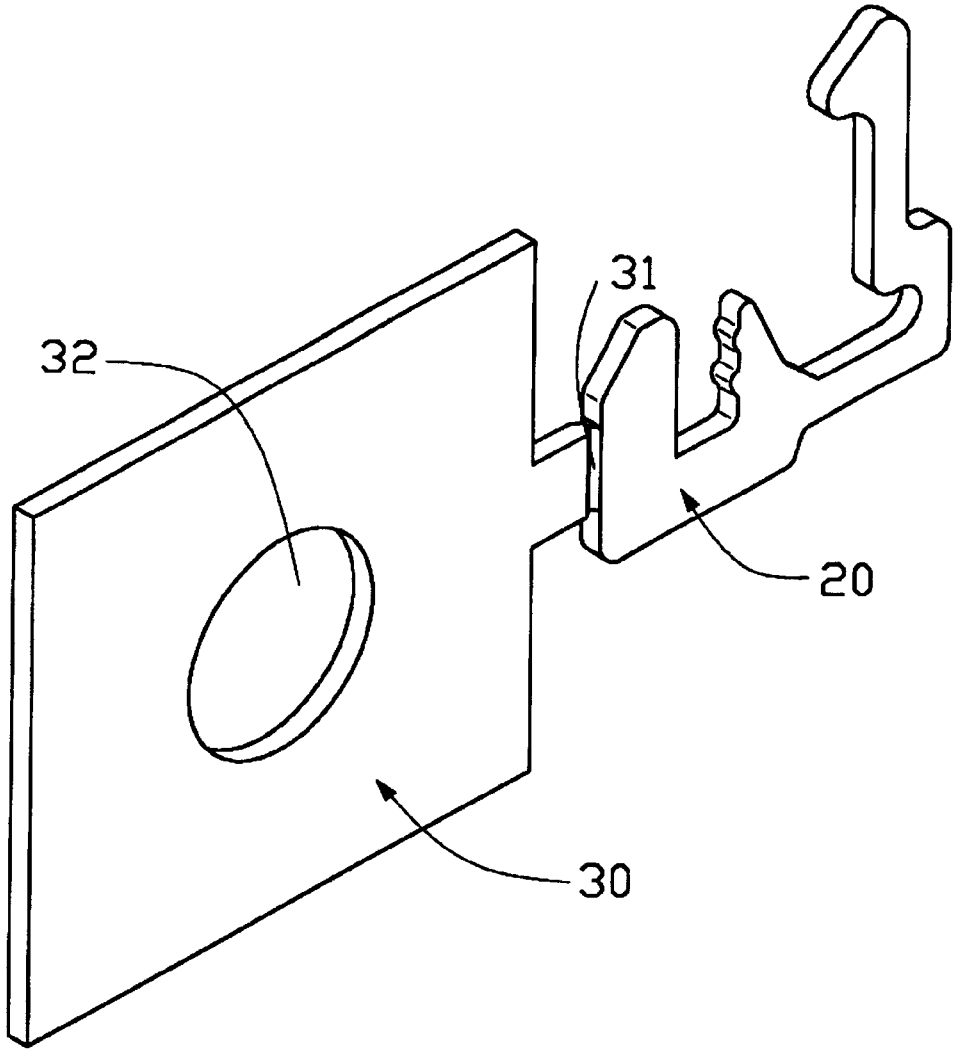
FIG. 3 is a perspective view of a contact with carrier strip.

Now referring to FIGS. 2–3, each contact comprises abase portion 21, a transition portion 27 and a spring contact arm 28. The base portion 21 forms an outer retention section 23 and an inner retention section 22 which cooperatively define a gap 25 therebetween. The base portion 21 defines a solder section 26 on a bottom thereof for soldering on the printed circuit board. The transition portion 27 includes a first horizontal section 271 horizontally and laterally extending from the base portion 21, a vertical section 272 perpendicularly and upwardly extending from the first horizontal section 271 and a second horizontal section 273 horizontally extending from the vertical section 272 towards the two retention sections. A spring contact arm 28 extends upwardly from the transition portion 27 and forms a protrusion 280 for electrical connection with a terminal of a mating connector. The contact of the present invention is produced using a blanking and stamping process so that the manufacture is easy. The contacts 20 are each connected to a strip carrier 30 at a V-shaped cut 31 allowing the contact to be easily separated from the carrier 30 after assembly in the housing 10 (see FIG. 3). A positioning hole 32 is defined at the center of the strip carrier 30 for use in automatic assembly of the contacts 20 in the housing 10.

Figure 4:
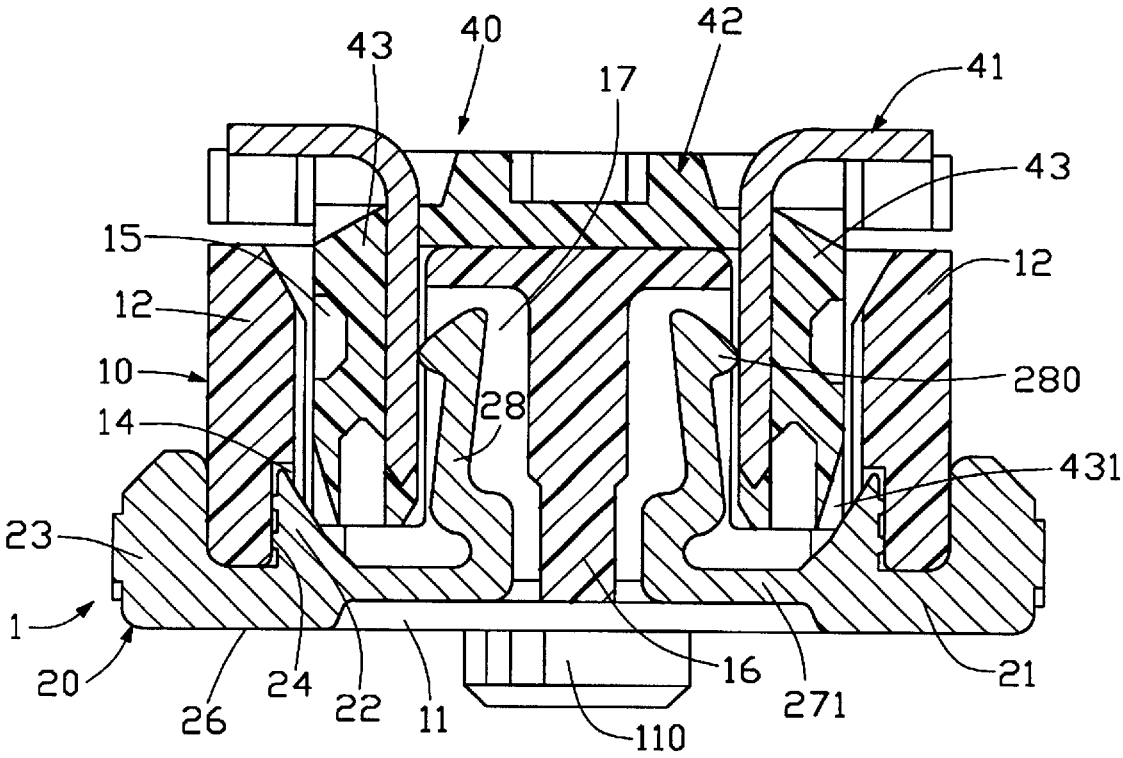
FIG. 4 is a sectional view showing that the electrical connector of the present invention and a mating electrical connector.
Figure 5:
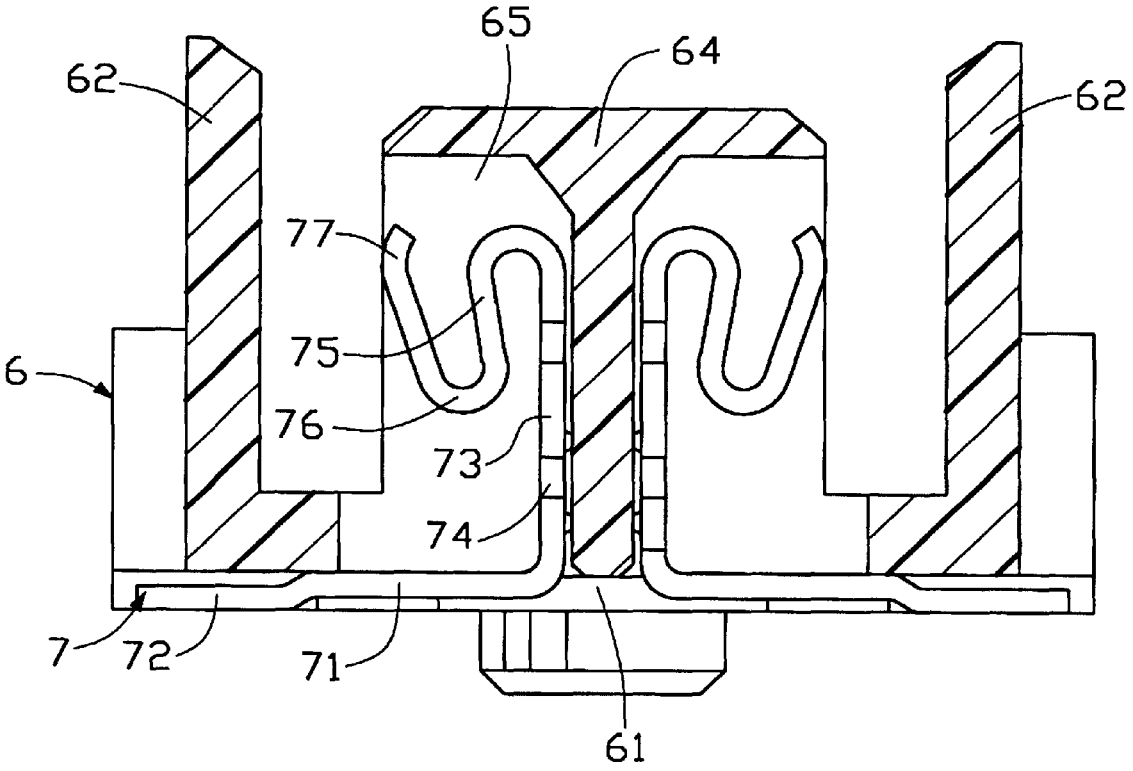
FIG. 5 (PRIOR ART)
FIG. 5 is a sectional view of a prior art electrical connector.
Figure 6:
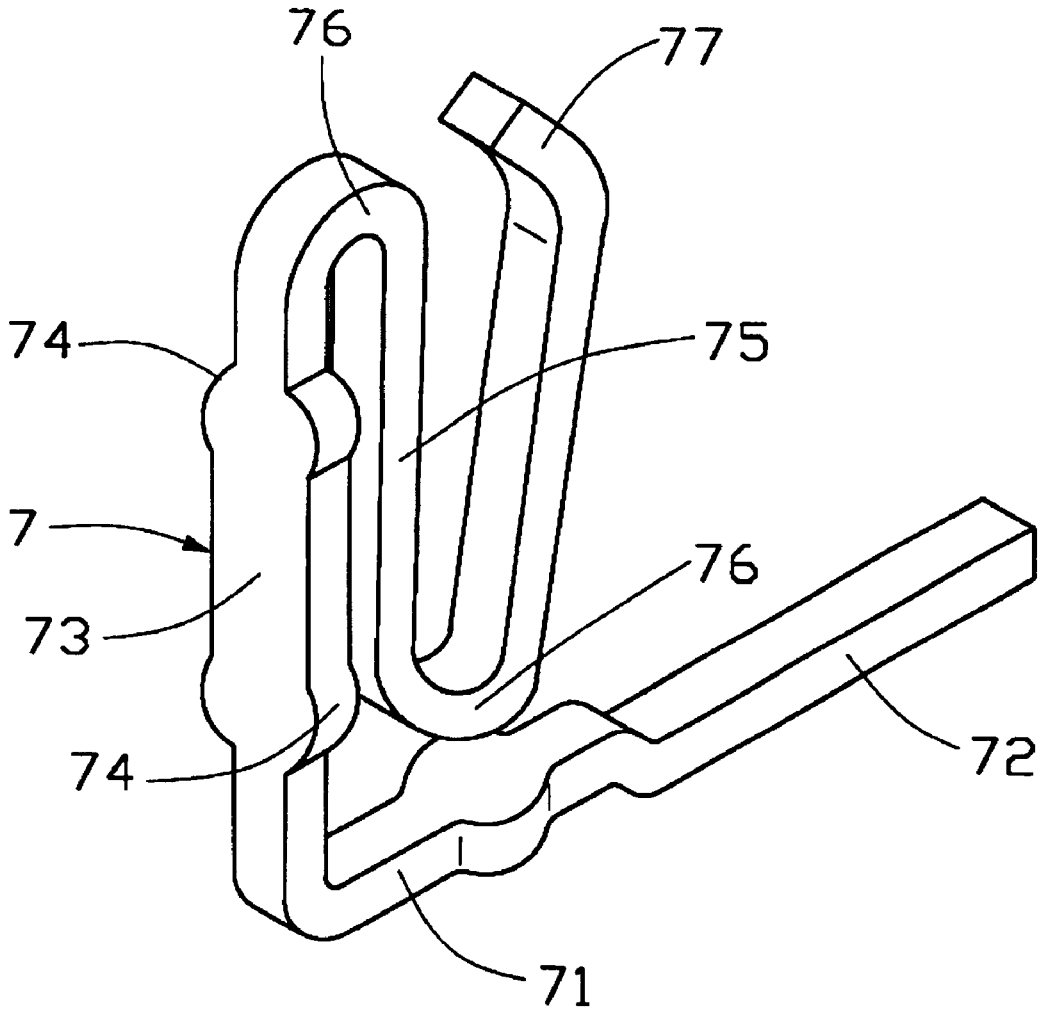
FIG. 6 (PRIOR ART)
FIG. 6 is a perspective view of a prior art contact of FIG. 5.

Referring to FIGS. 1 and 4, in assembly, each contact 20 is inserted in the housing 10, the inner retention section 22 and the outer retention section 23 cooperating to secure the sidewall 12 therebetween. Arced projections 24 of the inner retention section 22 interferingly fit in the recess 14 of the sidewall 12 thereby fixing the contact 20 in the housing 10. The transition portion 27 and spring contact arm 28 of the contact 20 are received in the contact receiving cavity 17. The solder section 26 is exposed beneath the housing 10 for soldering to the printed circuit board. Each contact is separate from an opposite contact in a transverse direction by the central projection 16, and is separated from neighboring contacts in a longitudinal direction by the ribs 19. In contrast to the prior art, since the arced projections 24 do not interferentially fit with the ribs 19, damage to the ribs 19 and consequent short circuiting between adjacent contacts is avoided. FIG. 4 shows the electrical connector 1 mating with a mating connector 40. The terminals 41 and sidewalls 43 of a housing 42 of the mating connector 40 are received in the receiving slots 15 of connector 1. When the contacts 20 mate with the terminals 41, the protrusions 280 of the contacts 20 resiliently engage with an opposite portion of the terminals 41 so that a firm electrical connection is established. The housing 42 defines therealong a plurality of recesses 431 in an exterior face of the side wall 43 and in alignment with both the corresponding contacts 20 and terminals 41, respectively, for receiving a portion of the inner retention section 22 of the corresponding contact 20. The three right angle transitions of the transition portion 27 provide the spring contact arm 28 with sufficient resiliency to accommodate the movement required in contacts 20 to establish the firm electrical connector with the terminals 41.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a bottom wall, two opposite sidewalls, and a central projection extending from the bottom wall between and parallel to the sidewalls, two receiving slots defined between the central projection and the sidewalls, the central projection defining on both sides thereof a plurality of contact receiving cavities through the bottom wall; and a plurality of contacts each comprising a base portion forming inner and outer retention sections for engaging with opposite sides of the sidewall, a transition portion including a first horizontal section horizontally and laterally extending from the base portion, a vertical section perpendicularly and upwardly extending from the horizontal section and a second horizontal section horizontally extending from the vertical section towards the inner and outer retention sections, and a spring contact arm perpendicularly and upwardly extending from the second horizontal section and received in the contact receiving cavity;

wherein the inner retention section of the base portion forms a plurality of arced projections projecting towards the outer retention section for interferingly fitting with the sidewall of the housing.

2. The electrical connector as claimed in claim 1, wherein the transition portion and spring contact arm of the contact form at least three right angle transitions.

3. The electrical connector as claimed in claim 1, wherein each of the plurality of contacts forms a protrusion at a distal end of the spring contact arm thereof, the protrusion projecting towards the inner and outer retention sections of the contact.

4. An electrical contact comprising:

a base portion forming upwardly projecting inner and outer retention sections, the inner and outer retention sections together defining a gap therebetween for receiving a sidewall of a housing on which the contact is mounted;

a transition portion including a first horizontal section extending from the base portion, a vertical section extending from the first horizontal section and a second horizontal section extending from the vertical section toward the inner and outer retention sections; and a spring contact arm upwardly extending from the second horizontal section of the transition portion;

wherein the inner retention section of the base portion forms a plurality of arced projections projecting into the gap defined between the inner and outer retention sections for interferingly fitting with a sidewall of a housing on which the contact is mounted.

5. The electrical contact as claimed in claim 4, wherein a protrusion is formed at a distal end of the spring contact arm projecting towards two retention sections.

6. The electrical contact as claimed in claim 4, wherein the contact forms a protrusion at a distal end of the spring contact arm projecting towards the inner and outer retention sections.

7. An electrical assembly comprising:

a first connector including:

a first housing defining at least one receiving slot and a plurality of first contact receiving cavities along a longitudinal direction thereof;

a plurality of first contacts respectively received within the corresponding first contact receiving cavities, each of said first contacts including a retention section abutting against an interior face of a corresponding first side wall of the first housing and protruding into the receiving slot; and a second connector including:

a second housing defining a plurality of second contacts thereof and a plurality of recesses in an exterior face of a front edge portion of a second side wall thereof and in alignment with the corresponding second contacts, respectively; wherein when assembled, the second housing is inserted into the receiving slot with said recesses freely receiving, without engagement thereof, the retention sections of the corresponding first contacts, respectively.

* * * * *